US006474565B1

(12) United States Patent
Ruehle et al.

(10) Patent No.: US 6,474,565 B1
(45) Date of Patent: Nov. 5, 2002

(54) FUEL INJECTION VALVE

(75) Inventors: Wolfgang Ruehle, Ditzingen; Hubert Stier, Asperg; Matthias Boee, Ludwigsburg; Guenther Hohl, Stuttgart; Norbert Keim, Loechgau, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,141

(22) PCT Filed: Jul. 13, 2000

(86) PCT No.: PCT/DE00/02279

§ 371 (c)(1),
(2), (4) Date: Jun. 15, 2001

(87) PCT Pub. No.: WO01/06115

PCT Pub. Date: Jan. 25, 2001

(30) Foreign Application Priority Data

Jul. 14, 1999 (DE) ..... 199 32 760

(51) Int. Cl.[7] ..... B05B 1/08

(52) U.S. Cl. ..... 239/102.1; 239/102.2; 239/533.2; 239/584; 239/585.1; 239/533.7

(58) Field of Search ..... 239/533.7, 533.2, 239/585.1, 585.2, 585.3, 585.4, 585.5, 102.1, 102.2, 584

(56) References Cited

U.S. PATENT DOCUMENTS

| | | | | |
|---|---|---|---|---|
| 3,194,162 A | * | 7/1965 | Williams | 239/102.2 |
| 4,553,059 A | | 11/1985 | Sakakibara et al. | |
| 4,725,002 A | * | 2/1988 | Trachte | 239/102.2 |
| 6,196,472 B1 | * | 3/2001 | Cooke | 239/102.2 |
| 6,213,414 B1 | * | 4/2001 | Stier et al. | 239/584 |

FOREIGN PATENT DOCUMENTS

| | | |
|---|---|---|
| DE | 40 05 455 | 8/1990 |
| GB | 2 094 940 | 9/1982 |

* cited by examiner

*Primary Examiner*—Robin O. Evans
(74) *Attorney, Agent, or Firm*—Kenyon & Kenyon

(57) ABSTRACT

A fuel injector (1), particularly an injection valve for fuel-injection systems of internal combustion engines, has a piezoelectric or magnetostrictive actuator (16) that is arranged in a valve housing (2) and is sealed off from a fuel by an actuator housing (15), and a valve-closure member (7) which is operable by the actuator (16) with the aid of a valve needle (6) and which cooperates with a valve-seat surface (5) to form a sealing seat. The valve housing (2) and the actuator housing (15) have cut-outs (38, 39) adjoining one another, and the valve housing (2) is joined to the actuator housing (15) in an edge area of the cut-outs (38, 39). In this manner, a feed-through opening (41) is formed which is sealed off from the fuel. The feed-through opening (41) is filled with a filler element (43) by which at least one electrical supply line (37) of the actuator (16) is fixed in position in the feed-through opening (41).

12 Claims, 4 Drawing Sheets

FUEL INJECTION VALVE

BACKGROUND OF THE INVENTION

The present invention is based on a fuel injector according to the species defined in the Main Claim.

A fuel injector of the type set forth in the Main claim is known from the German Patent 40 05 455 A1.

The fuel injector derived from this document has a piezoelectric actuator and a valve-closure member that is operable by a valve needle and cooperates with a valve-seat surface to form a sealing seat. The actuator is arranged on the end of the fuel injector facing away from the spray-discharge side, and is sealed off by a spring diaphragm, extending over the cross-section of the fuel injector, from a fuel introduced laterally and in the spray-discharge direction below the spring diaphragm. The spring diaphragm therefore divides the fuel injector into a section on the spray-discharge side filled with fuel, and a section, sealed off from the fuel, in which the actuator is located. The sealed-off section of the fuel injector has an electrical connection via which an electrical supply line is run to the actuator. The electrical connection is inserted into a bore hole placed laterally on the valve housing of the fuel injector.

Disadvantageous in the fuel injector known from DE 40 05 455 A1 is that the fuel can only be introduced into the fuel injector via a fuel-inlet connection mounted laterally on the valve housing and disposed below the spring diaphragm in the spray-discharge direction. In particular, the fuel cannot be introduced into the fuel injector via the end of the valve housing opposite the spray-discharge side. Both the length and the diameter of the fuel injector are increased due to the disadvantageous position of the fuel-inlet connection.

Another disadvantage is that the actuator is not protected from substances such as leak oil and leak fuel penetrating via the separating line between the valve housing and the electrical connection. In addition, the joining of the electrical connection to an electrical contact of the actuator takes too much effort, since the actuator is introduced into the valve housing via an opening at the extremity, and the electrical connections are guided laterally to the actuator.

ADVANTAGES OF THE INVENTION

In contrast, the fuel injector of the present invention having the characterizing features of the Main Claim has the advantage that the actuator is completely sealed off, this sealing being suitable for any fuel injectors, and in addition, an electrical supply line of the actuator can be connected in a simple manner to an electrical connection.

Measures specified in the dependent claims permit advantageous further developments of the fuel injector indicated in the Main Claim.

The electrical supply line is advantageously constructed as a contact tag forming an angle at the actuator. A reliable electrical contacting at the actuator is achieved in this manner, it being possible for an electrical connection to be provided by the electrical supply line at the same time.

It is advantageous that the filler element is a cured filling compound or a flexible solid. The filler element can thereby be introduced in a simple manner into the feed-through opening, it adapting to the particular shape of the feed-through opening.

It is also advantageous that the fuel injector has a plastic casing which covers the filler element of the feed-through opening. This provides a further protection for the feed-through opening and the filler element filling the feed-through opening, particularly against mechanical stress, it being possible for the plastic casing, together with the electrical supply line, to form an electrical connection.

It is an advantage that a space formed between the valve housing and the actuator housing tapers continuously in the edge area of the feed-through opening toward said feed-through opening. The valve housing and the actuator housing are thereby bent toward each other, the cut-outs of the valve housing and of the actuator housing directly adjoining each other, thus simplifying the sealing from the standpoint of production engineering.

Another advantage is that, to secure the armature housing to the valve housing, a space formed between the valve housing and the actuator housing tapers continuously in a region of a further cut-out of the valve housing. In this manner, the valve housing abuts against the actuator housing, thereby achieving a stabilizing contact of the actuator housing against the valve housing, which means an easily implemented mounting of the actuator in the fuel injector is yielded by securing the actuator housing to the valve housing. In this context, it is in turn particularly advantageous if the valve housing has an inwardly bent lateral surface for forming the continuously tapering space in the region of at least one cut-out of the valve housing.

The valve housing is advantageously joined to the actuator housing at at least one cut-out of the valve housing by a circumferential welded seam. This yields a reliable, integral joining with form locking which permits a seal and attachment that is resistant to ageing and exhibits long-term stability.

DRAWING

Exemplary embodiments of the present invention are explained in greater detail in the following description and are shown, simplified, in the Drawing, in which.

DESCRIPTION OF THE EXEMPLARY EMBODIMENTS

Figure 1:
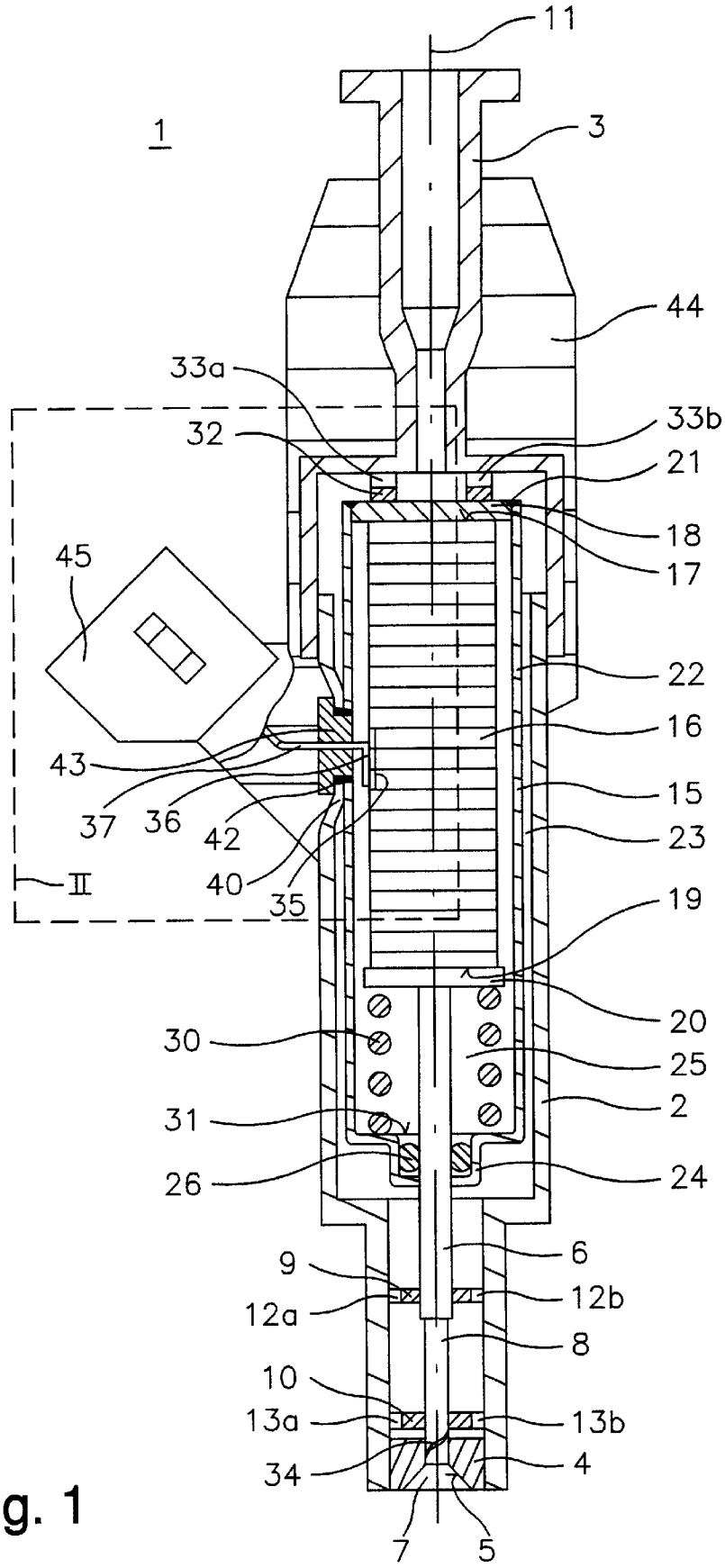
FIG. 1 shows a first exemplary embodiment of the fuel injector according to the present invention.
Figure 2:
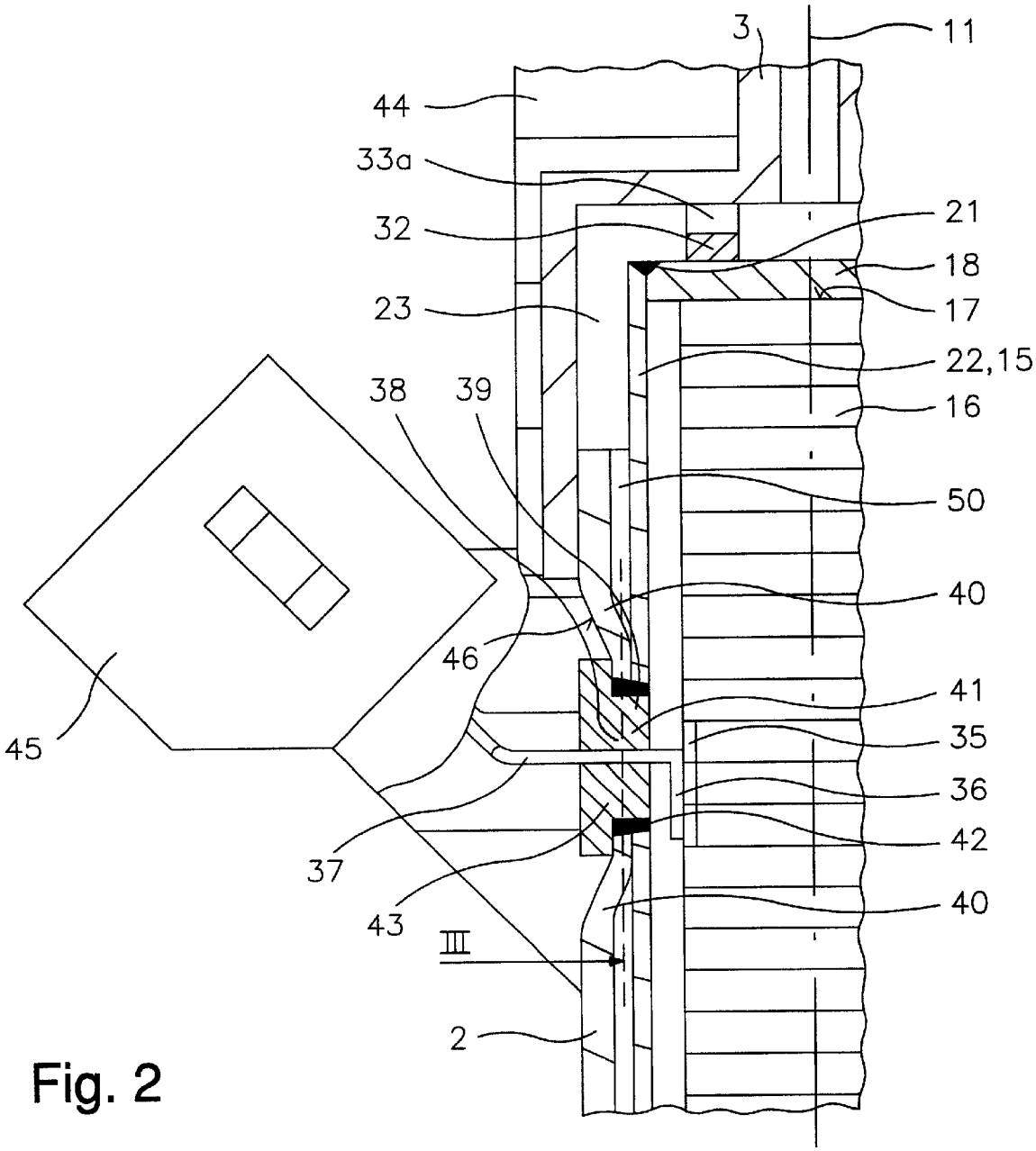
FIG. 2 shows the segment designated by II in FIG. 1.

FIG. 1, in a partial, axial, sectional view, shows a fuel injector 1 of the present invention, segment II being shown again, enlarged, in FIG. 2. Fuel injector 1 is used as a so-called direct gasoline injection valve, in particular for the direct injection of fuel, especially gasoline, into a combustion chamber of a mixture-compressing internal combustion engine with externally supplied ignition. However, fuel injector 1 of the present invention is also suitable for other application cases.

Fuel injector 1 has a valve housing 2 and a fuel-inlet connection 3 joined to valve housing 2. Formed on a valve-seat member 4, that is joined to valve housing 2, is a valve-seat surface 5 which cooperates with a valve-closure member 7, operable by a valve needle 6, to form a sealing seat. In this exemplary embodiment, valve-closure member 7 is formed in one piece with valve needle 6, valve needle 6 having a section 8 with a reduced diameter. Valve needle 6 is guided by valve-needle guideways 9 and 10 in the axial direction with respect to valve axis 11. Valve-needle guideways 9, 10 have cut-outs 12*a*, 12*b*; 13*a*, 13*b* to allow the passage of fuel.

In the interior of the valve housing 2 of fuel injector 1 is a piezoelectric or magnetostrictive actuator 16 that is surrounded by an actuator housing 15 and that abuts at an upper end face 17 against a pressure plate 18 of actuator housing 15. In addition, actuator 16, at a lower end face 19, abuts against a pressure plate 20 which is joined to valve needle 6. Pressure plate 18 is joined to an actuator pot 22 of actuator housing 15 by a circumferential welded seam 21. Formed between actuator pot 22 and valve housing 2 is a tubular space 23 via which the fuel is guided from fuel-inlet connection 3 in the direction of the sealing seat formed by valve-closure member 7 and valve-seat surface 5.

Actuator pot 22 has a section 24 with reduced diameter at its end on the spray-discharge side. Formed on section 24 is a cut-out through which valve needle 6 protrudes. An actuator chamber 25 is sealed off from the fuel in tubular space 23 by a seal 26 which in particular can be formed as an elastomer seal.

A prestress is applied to actuator 16 via compression spring 30 which is braced against an inner surface 31 of actuator pot 22 and of pressure plate 20. Actuator housing 15 is supported against fuel-inlet connection 3 via an annular support element 32. Support element 32 has cut-outs 33*a*, 33*b* to allow the passage of fuel.

To actuate fuel injector 1, an electrical voltage acts upon actuator 16 causing it to expand and act upon valve needle 6 via pressure plate 20, valve-closure member 7 thereby lifting off of valve-seat surface 5 of valve-seat member 4, and the fuel being ejected from fuel injector 1 via, for example, swirl grooves 34 formed on valve needle 6.

Actuator 16 is joined at an electrical contact 35 to an angled end of an electrical supply line 37. In this context, electrical supply line 37 can be formed as a contact tag. In addition, angled end 36 can be joined to electrical contact 35 via a soldered connection. Actuator pot 15 and valve housing 2 have cut-outs 38, 39 adjoining each other (FIG. 2), through which electrical supply line 37 protrudes. Valve housing 2 is joined in an edge area 40 of cut-outs 38, 39 to actuator housing 15, a feed-through opening 41 thereby being formed which is sealed off from the fuel. In this exemplary embodiment, valve housing 2 is attached to actuator housing 15 by a circumferential welded seam 42. Feed-through opening 41 is filled with a filler element 43, electrical supply line 37 being fixed in position and supported in feed-through opening 41 by filler element 43.

Filler element 43 can be provided by a plurality of materials. It is advantageous if filler element 43 is provided by a curing filling compound, since the filling compound can be injected into feed-through opening 41 and thus adapts to feed-through opening 41 and to electrical supply line 37, so that after the filling compound has cured, filler element 43 reliably seals off actuator 16, even if the production of feed-through opening 41 deviates structurally. Another possibility is to form filler element 43 as a flexible solid, particularly as a plastic ring which has at least one cut-out, so that filler element 43 can be inserted into feed-through opening 41, even if angled end 36 is already soldered on actuator 16.

Actuator 16 is completely sealed off in actuator housing 15 by filler element 43 so that substances, particularly leakages, present outside of valve housing 2 of fuel injector 1 also cannot penetrate at actuator 16.

To form an electrical connector element and to join valve housing 2 to fuel-inlet connection 3, valve housing 2 and fuel-inlet connection 3 are enclosed at least by sectors with a plastic casing 44 which, to protect feed-through opening 41, also extends over it, so that filler element 43 is covered by plastic casing 44. Electrical supply line 37 extends into a connector element 45 which is part of plastic casing 44, an electrical attachment plug thereby being formed.

Formed between valve housing 2 and actuator housing 15 is a space 50 which tapers continuously in edge area 40 of feed-through opening 41 toward said feed-through opening 41. To form continuously tapering space 50, valve housing 2 has an inwardly bent lateral surface 46 in the region of cut-out 38 of valve housing 2. Therefore, in the edge area of feed-through opening 41, valve housing 2 abuts against actuator housing 15, they being joined to one another by welded seam 42.

Figure 3:
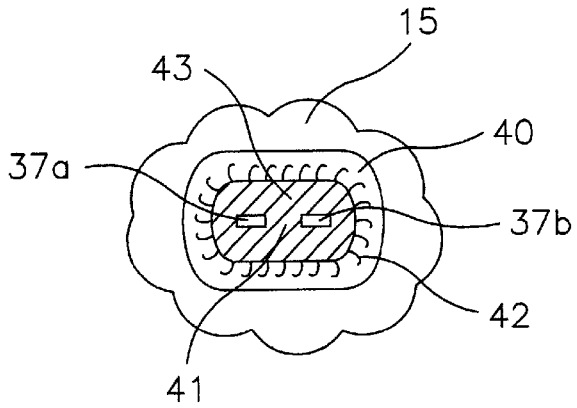
FIG. 3 shows the section designated by III in FIG. 2.

FIG. 3 shows a section along the line of intersection designated by III in FIG. 2. Corresponding elements are provided with identical reference numerals in all figures.

Electrical supply line 37 has two electrical contacts 37*a*, 37*b* which are guided through feed-through opening 41. Feed-through opening 41 is filled with filler element 43 in order to fix electrical supply line 37 of actuator 16 in position. The joining of electrical supply line 37 to actuator 16 is thereby mechanically relieved. In addition, in this exemplary embodiment, electrical supply line 37 can be guided, without its own electrical insulation, to actuator 16 if an electrically insulating filler element 43 is used for filling feed-through opening 41, since the two contacts 37*a*, 37*b* of electrical supply line 37 are reliably insulated from each other. Furthermore, feed-through opening 41 is sealed by filler element 43, thus preventing substances, particularly liquids such as water, gasoline and leak oil, from penetrating.

Figure 4:
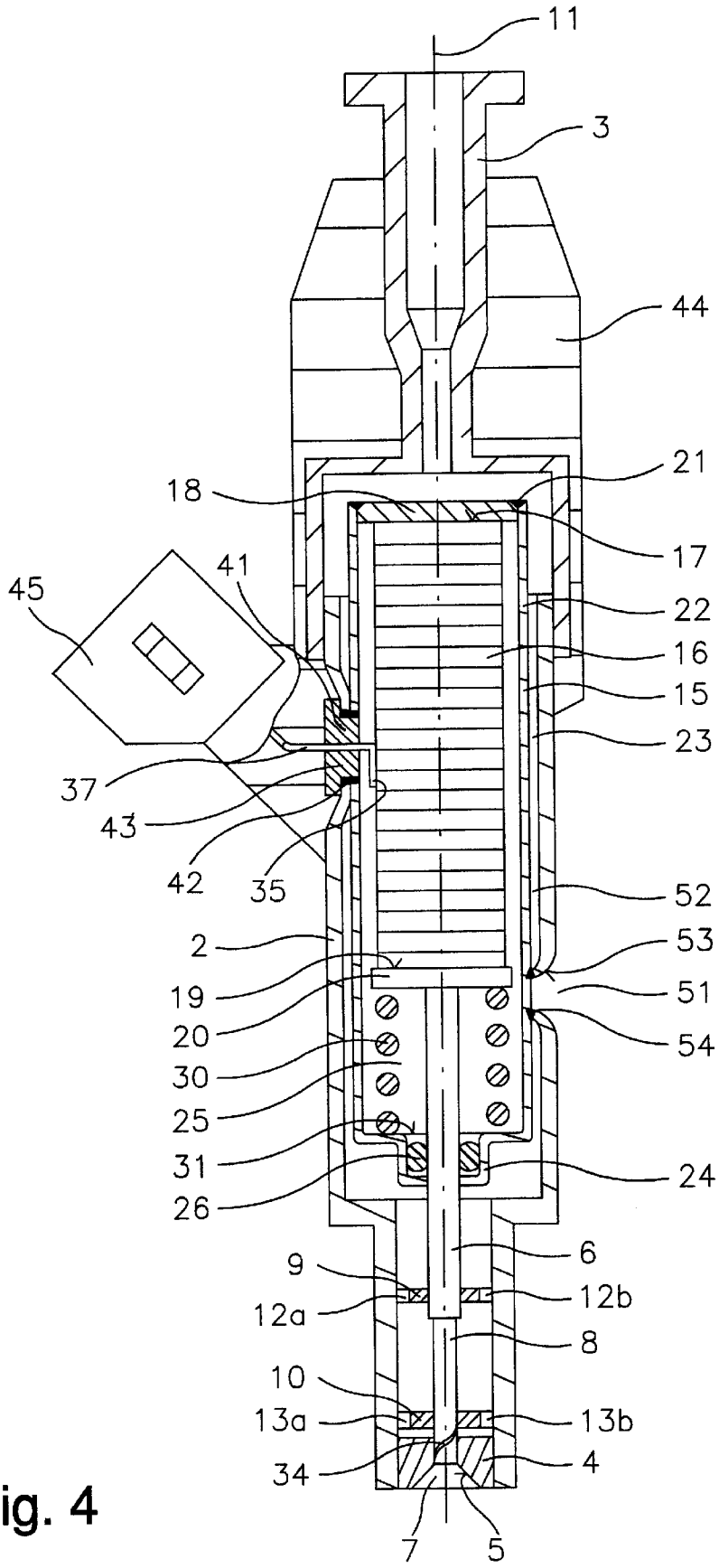
FIG. 4 shows a further exemplary embodiment of the fuel injector according to the present invention.

FIG. 4 shows a further exemplary embodiment of a fuel injector 1 according to the present invention. In this exemplary embodiment, valve housing 2 has a further cutout 51. In this context, valve housing 2 is bent toward actuator housing 15 in the region of further cut-out 51 of valve housing 2, in order to form a continuously tapering space 52, so that valve housing 2 has an inwardly bent lateral surface 53 in the edge area of further cut-out 51. Valve housing 2, bent inwardly in the edge area of cut-out 51, is joined to actuator housing 15 by a circumferential welded seam 54.

In this manner, actuator housing 15 is joined to valve housing 2 both by circumferential welded seam 42 and by circumferential welded seam 54. Actuator housing 15 can be joined in a similar manner to valve housing 2 at further locations. Actuator housing 15 can also be supported against valve housing 2 by way of support elements like, for example, support element 32 in FIGS. 1 and 2, which can also be disposed in tubular space 23.

The attachment of actuator housing 15 to valve housing 2 via the two welded seams 42 and 54 yields a mounting of actuator 16 in fuel injector 1 which is easy to implement, it being possible to align valve needle 8 in a simple manner by applying welded seams 42, 54. The deformation of actuator housing 2 in the edge area of feedthrough opening 41 and in the edge area of cut-out 51 can be achieved by cold forming, so that production can also be carried out cost-effectively.

Figure 5:
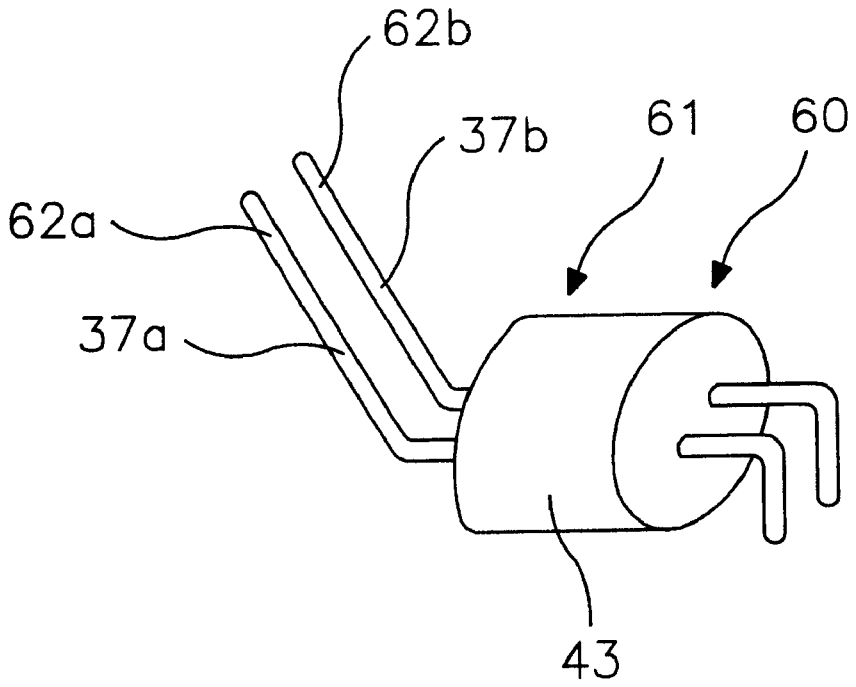
FIG. 5 shows another exemplary embodiment of the fuel injector according to the present invention.

FIG. 5 shows another exemplary embodiment of the fuel injector according to the present invention.

In this exemplary embodiment, electrical supply line 37*a*, 37*b* is fixed in position in region 60 by filler element 43 in a feed-through opening 41 (not shown). In addition, electrical supply line 37*a*, 37*b* is also surrounded by filler element 43 outside of region 60 of feed-through opening 41, so that electrical supply line 37*a*, 37*b* is also fixed in position by filler element 43 outside of region 60, i.e., in a region 61. This is particularly advantageous when high mechanical stresses can be expected on supply leads 37*a*, 37*b* to actuator 16, as occur, for example, when, after introducing filler element 43, fuel injector 1 is provided with a plastic casing at least partially enclosing supply line 37*a*, 37*b*. Ends 62*a*, 62*b* of electrical supply line 37*a*, 37*b* are thereby fixed in a defined position, so that an electrical connection is advantageously yielded by extrusion coat 44 and ends 62*a*, 62*b*.

The invention is not restricted to the exemplary embodiments described. In particular, the invention is also suitable for a fuel injector 1 opening to the inside.

What is claimed is:

1. A fuel injector, comprising:

an actuator housing;

a valve housing;

one of a piezoelectric actuator and a magnetostrictive actuator arranged in the valve housing and being sealed off from a fuel by the actuator housing;

a valve needle;

a valve seat surface;

a valve-closure member that is operable by the one of the piezoelectric actuator and the magnetostrictive actuator in accordance with an operation of the valve needle, the valve-closure member cooperating with the valve-seat surface to form a sealing seat; and a filler element, wherein:

the valve housing and the actuator housing include cut-outs adjoining one another, the valve housing is joined to the actuator housing in an edge area of the cut-outs, thereby forming a feed-through opening sealed off from the fuel, and the feed-through opening is filled with the filler element by which at least one electrical supply line of the one of the piezoelectric actuator and the magnetostrictive actuator is fixed in position in the feed-through opening.

2. The fuel injector according to claim 1, wherein:

the fuel injector corresponds to an injection valve for a fuel injection system of an internal combustion engine.

3. The fuel injector according to claim 1, wherein:

the at least one electrical supply line is soldered onto the one of the piezoelectric actuator and the magnetostrictive actuator.

4. The fuel injector according to claim 1, wherein:

the at least one electrical supply line corresponds to a contact tag forming an angle at the one of the piezoelectric actuator and the magnetostrictive actuator.

5. The fuel injector according to claim 1, wherein:

the filler element includes one of a cured filling compound and a flexible solid.

6. The fuel injector according to claim 1, further comprising:

a plastic casing covering the filler element of the feed-through opening.

7. The fuel injector according to claim 1, wherein:

a space that is formed between the valve housing and the actuator housing tapers continuously in an edge area of the feed-through opening toward the feed-through opening.

8. The fuel injector according to claim 1, wherein:

a space that is formed between the valve housing and the actuator housing tapers continuously in an edge area of a further cut-out of the valve housing in order to attach the actuator housing to the valve housing.

9. The fuel injector according to claim 7, wherein:

in order to form the continuously tapering space, the valve housing includes an inwardly bent lateral surface in the edge area of at least one of the cut-outs.

10. The fuel injector according to claim 8, wherein:

in order to form the continuously tapering space, the valve housing includes an inwardly bent lateral surface in the edge area of at least one of the cut-outs.

11. The fuel injector according to claim 1, wherein:

the valve housing is joined to the actuator housing at at least one of the cut-outs of the valve housing by a circumferential welded seam.

12. The fuel injector according to claim 1, wherein:

the filler element at least partially surrounds the at least one electrical supply line of the one of the piezoelectric actuator and the magnetostrictive actuator outside of the feed-through opening.

* * * * *

UNITED STATES PATENT AND TRADEMARK OFFICE

CERTIFICATE OF CORRECTION

PATENT NO. : 6,474,565 B1
DATED : November 5, 2002
INVENTOR(S) : Ruehle et al.

It is certified that error appears in the above-identified patent and that said Letters Patent is hereby corrected as shown below:

Title page,
Item [57], ABSTRACT,
Line 1, delete "(1)".
Lines 3, 6 and 15, delete "(16)".
Lines 4, 8 and 10, delete "(2)".
Lines 5, 9 and 11, delete "(15)".
Line 5, delete "(7)".
Line 7, delete "(6)".
Lines 7 and 8, delete "(5)".
Lines 9 and 11, delete "(38, 39)".
Lines 12, 13 and 16, delete "(41)".
Line 14, delete "(43)".
Line 15, delete "(37)".

Column 1,
Line 4, change "BACKGROUND OF THE INVENTION" to -- FIELD OF THE INVENTION --.
Line 5, change "The present invention is based on a fuel injector according to the species defined in the Main Claim" to -- The present invention relates to a fuel injector. --.
Line 7, delete "A fuel injector of the type set forth in the Main Claim is known from the German Patent".
Line 7, insert -- BACKGROUND INFORMATION --.
Line 8, insert -- A fuel injector is described in German Published Patent Application No. --.
Lines 8 and 26, delete "A1".
Line 9, delete "derived from this document".
Line 9, change "The fuel injector" to -- The fuel injector described in German Published Patent Application No. 40 05 455 --.
Line 25, delete "known from DE".
Line 25, change "the fuel injector" to -- The fuel injector described in German Published Patent Application No. --.
Line 43, change "ADVANTAGES OF THE INVENTION" to -- SUMMARY OF THE INVENTION --.
Lines 44 and 45, delete "having the characterizing features of the Main Claim".
Delete lines 52 through 54.

Column 2,
Line 7, change "of the feed-through opening toward said feed-through opening." to -- of the feed-through opening toward the feed-through opening --
Line 32, change "DRAWING" to -- BRIEF DESCRIPTION OF THE DRAWING --
Delete lines 35 to 37.

UNITED STATES PATENT AND TRADEMARK OFFICE

CERTIFICATE OF CORRECTION

PATENT NO. : 6,474,565 B1
DATED : November 5, 2002
INVENTOR(S) : Ruehle et al.

It is certified that error appears in the above-identified patent and that said Letters Patent is hereby corrected as shown below:

Column 2 (cont'd),
Line 38, change "according to the present invention;" to -- according to the present invention --
Line 39, change "in FIG. 1;" to -- in FIG. 1. --
Line 40, change "in FIG. 2;" to -- in FIG. 2. --
Line 42, change "according to the present invention; and" to -- according to the present invention. --
Line 47, change "DESCRIPTION OF THE EXEMPLARY EMBODIMENTS" to -- DETAILED DESCRIPTION --

Column 3,
Line 39, change "Actuator pot 15" to -- Actuator pot 22 --

Column 4,
Line 11, change "toward said feed-through opening" to -- toward the feed-through opening --
Line 58, change "The deformation of actuator" to -- The deformation of valve --

Column 5,
Line 13, change "The invention is not restricted" to -- the present invention is not restricted --
Line 14, change "In particular, the invention" to -- In particular, the present invention --

Signed and Sealed this

Twenty-eighth Day of October, 2003

JAMES E. ROGAN
*Director of the United States Patent and Trademark Office*